US005384089A

United States Patent [19]

Diamond

[11] Patent Number: 5,384,089

[45] Date of Patent: Jan. 24, 1995

[54] YELLOW KARAT GOLD CASTING ALLOYS

[76] Inventor: Lawrence H. Diamond, 692 Mildred Ave., Teaneck, N.J. 07666

[21] Appl. No.: 235,962

[22] Filed: May 2, 1994

[51] Int. Cl.[6] ..... C22C 5/02; C22C 30/00

[52] U.S. Cl. ..... 420/511; 420/512; 420/587

[58] Field of Search ..... 420/511, 512, 587; 148/430, 432

[56] References Cited

U.S. PATENT DOCUMENTS

| | | | |
|---|---|---|---|
| 4,444,719 | 4/1984 | Sakakibara et al. | 420/511 |
| 4,804,517 | 2/1989 | Schaffer | 420/587 |
| 4,917,861 | 4/1990 | Schaffer et al. | 420/463 |
| 4,943,483 | 7/1990 | Ingersoll et al. | 428/433 |

FOREIGN PATENT DOCUMENTS

| | | | |
|---|---|---|---|
| 54-71719 | 6/1979 | Japan | 420/512 |
| 56-96844 | 8/1981 | Japan | 420/512 |
| 59-157237 | 9/1984 | Japan | 420/511 |

*Primary Examiner*—Deborah Yee
*Attorney, Agent, or Firm*—Charles E. Temko

[57] ABSTRACT

The disclosure relates to yellow karat gold metal alloys particularly suited for the casting of jewelry articles such as rings, bracelets, earrings, and the like. The alloys include varying amounts of germanium up to about one percent by weight of the total volume of the alloy which serves as an oxygen scavenger, and which may be recycled along with scrap alloy material after casting. By varying the amounts of the grain refiners, it is possible to totally eliminate the use of deoxidizing agents such as silicon and boron and the accompanying disadvantageous effects of these elements, to result in a superior cast structure.

5 Claims, No Drawings

YELLOW KARAT GOLD CASTING ALLOYS

BACKGROUND OF THE INVENTION

This invention relates generally to the field of metallurgy, and more particularly to improved precious metal alloys suitable for casting articles of jewelry, including finger rings, bracelets, earrings and the like. Although certain aspects of the present invention have utility in the casting of non-precious metals, the disclosed technology has particular application in the casting of yellow karat gold alloys in which the percentage of gold is at least 33 percent, e.g. 10 karat.

The casting of articles using such alloys, typically by the so-called "lost wax" process includes problems which are well known in the art, and which have not been readily solved. To reduce labor costs, the cast article should possess a bright outer surface requiring little, if any, further finishing. The mechanical strength of the article is also important, particularly where the article or parts of the same includes parts of relatively thin cross section, because of necessary configuration, or to conserve the use of relatively expensive material. Where improper casting techniques and materials are used, the resultant castings are often of excessively large grain size resulting in correspondingly lower strength, and in some cases, actual cracking in the cast articles. Even in cases where cracks do not initially appear, where, for example, a ring is slightly enlarged, the working of the metal can often result in such cracking. Other problems include excessive hardness of the material, particularly when visible at the exposed surfaces. A particularly common problem is the appearance of "hard spots" of material which project above the finished surface of the article, and which are often so hard and brittle, that they cannot be removed by mechanical operations such as filing and the like. Under certain conditions, the copper content of the alloy provides a blackened oxidized coating on the outer surface of the casting which requires a mechanical and/or chemical operation to remove.

The above problems are not of recent origin, and considerable research has been conducted in the prior art. Some of the problems are solved by removing excess oxygen from the molten alloy, and this has commonly been accomplished by the use of silicon or boron. Unfortunately, such use has undesirable side effects. Silicon is notorious for increasing grain size and porosity, particularly used in the relatively large amounts necessary to achieve effect deoxidization. Boron can be used in relatively lesser amounts, but does produce somewhat similar results. To some extent, these side effects are compensated by the use of other compositions which tend to diminish grain size, such as iridium, nickel, cobalt, and ruthenium. Small amounts of zinc are used to make the alloy somewhat more workable and increase fluidity of the molten alloy when transferred from crucible to flask, and thus improve surface roughness, form filling and strength of the casting. Zinc also has some deoxidizing capability and helps in color shading of yellow gold.

While not commonly used, the use of germanium in amounts of up to one percent of the total volume by weight is not unknown, the germanium serving as a recyclable oxygen scavenger. When used with excessive amounts of boron and silicon, there is a tendency to decolor the yellow appearance of the alloy. When used, it has normally been in combination with lithium, and such use has been confined to gold alloys containing less than 33 percent gold.

To the extent that I have been able to determine, the use of germanium as a sole oxygen scavenging constituent has not been appreciated in the prior art. Yet, in the case of gold karat metal alloys, its use in the absence of silicon and boron enables the use of many known grain enhancement additives in relatively modest amounts to be extremely effective, and without the undesirable characteristics normally present in the cast article.

SUMMARY OF THE INVENTION

Briefly stated, the invention contemplates the provision of improved yellow gold karat metal alloys ranging from 8 karat to 22 karat in which the desired qualities of grain refining, surface smoothness, form filling, strength, hardness and porosity, are substantially improved by employing varying amounts of germanium in the substantial absence of either silicon or boron. Scrap amounts of alloys containing only germanium as an oxygen scavenger may not only be reused, but the germanium reduced of its oxygen content, so that the scrap materials requires no addition of unoxidized germanium. The alloys may be made as master alloys to be mixed with gold. In such case, the remaining ingredients are mixed in these same proportions.

DETAILED DESCRIPTION OF THE DISCLOSED EMBODIMENTS

With reference to the above discussion, the following examples represent the best modes of employing the invention, but are considered to be illustrative. Proportions are by weight.

EXAMPLE 1—Yellow 14 Karat Alloy 58.33 Parts Gold
29.34 Parts Copper
7.08 Parts Silver
5.00 Parts Zinc
0.21 Parts Germanium
0.04 Parts Iridium

EXAMPLE 2

58.33 Parts Gold
28.55 Parts Copper
7.08 Parts Silver
5.00 Parts Zinc
0.21 Parts Germanium
0.83 Parts Nickel

EXAMPLE 3

58.33 Parts Gold
28.55 Parts Cooper
7.08 Parts Silver
0.21 Parts Germanium
0.83 Parts Cobalt

EXAMPLE 4

58.33 Parts Gold
29.34 Parts Copper
7.08 Parts Silver
5.00 Parts Zinc
0.21 Parts Germanium
0.04 Parts Ruthenium

EXAMPLE 5

58.33 Parts Gold 29.05 Parts Copper
7.08 Parts Silver
5.03 Parts Zinc
0.50 Parts Germanium
0.04 Parts Iridium

EXAMPLE 6

58.30 Parts Gold
26.59 Parts Copper
7.08 Parts Silver
5.03 Parts Zinc
1.00 Parts Germanium
2.00 Parts Cobalt

EXAMPLE 7

58.30 Parts Gold
26.59 Parts Copper
7.08 Parts Silver
5.03 Parts Zinc
1.00 Parts Germanium
2.00 Parts Nickel

EXAMPLE 8

58.30 Parts Gold
26.59 Parts Copper
7.08 Parts Silver
5.03 Parts Zinc
1.00 Parts Germanium
0.66 Parts Cobalt
1.34 Parts Nickel EXAMPLE 9—Yellow 10 Karat Alloy 41.67 Parts Gold
11.32 Parts Silver
40.83 Parts Copper
5.83 Parts Zinc
0.29 Parts Germanium
0.06 Parts Iridium

EXAMPLE 10

41.67 Parts Gold
11.32 Parts Silver
40.83 Parts Copper
5.83 Parts Zinc
0.29 Parts Germanium
0.06 Parts Ruthenium

EXAMPLE 11

41.67 Parts Gold
39.73 Parts Copper
11.32 Parts Silver
5.83 Parts Zinc
0.29 Parts Germanium
2.00 Parts Nickel

EXAMPLE 12

41.67 Parts Gold
39.73 Parts Copper
11.32 Parts Silver
5.83 Parts Zinc
0.29 Parts Germanium
2.00 Parts Cobalt

EXAMPLE 13

41.67 Parts Gold
39.73 Parts Copper
11.32 Parts Silver
5.83 Parts Zinc
0.29 Parts Germanium
2.00 Parts Nickel

EXAMPLE 14

41.67 Parts Gold
33.13 Parts Copper
16.74 Parts Silver
6.29 Parts Zinc
1.00 Parts Germanium
1.17 Parts Nickel

EXAMPLE 15

41.67 Parts Gold
40.83 Parts Copper
11.32 Parts Silver
5.62 Parts Zinc
0.50 Parts Germanium
0.06 Parts Iridium

EXAMPLE 16

41.67 Parts Gold
38.89 Parts Copper
11.32 Parts Silver
5.12 Parts Zinc
1.00 Parts Germanium
2.00 Parts Nickel EXAMPLE 17
41.67 Parts Gold
38.89 Parts Copper
11.32 Parts Silver
5.12 Parts Zinc
1.00 Parts Germanium
2.00 Parts Cobalt Similarly, when the upper limits of germanium composition in these karat gold alloys have to be determined, casting conditions such as protective atmospheres, hermetic tightness of the casting and melting system, crucible composition and cost are of essence.

One percent of germanium and below is a more optimum composition using nickel or cobalt or both. A finer grain structure with few, if any, hard spots and cracks will result.

If iridium is the grain refiner, then much less such as 0.5 percent germanium will give optimum results. In addition, the presence of boron or silicon will lead to excessive hard spots.

The following examples are illustrative:

EXAMPLE 18A 41.67 Parts Gold
39.811 Parts Copper
11.32 Parts Silver
5.83 Parts Zinc
0.29 Parts Germanium
0.076 Parts Silicon
1.00 Parts Cobalt
0.003 Parts Boron

EXAMPLE 18B 41.67 Parts Gold
39.811 Parts Copper
11.32 Parts Silver
5.83 Parts Zinc
0.29 Parts Germanium
0,076 Parts Silicon
2.00 Parts Nickel
0.003 Parts Boron Examples 18a and 18b will impart a shiny finish on the cast article not requiring further polishing.

EXAMPLE 19—18 Karat Yellow Gold Alloy 75.0 Parts Gold
15.2 Parts Silver
7.32 Parts Copper
2.10 Parts Zinc
0.13 Parts Germanium
0.25 Parts Nickel EXAMPLE 20—8 Karat Yellow Gold Alloy 33.33 Parts Gold
47.33 Parts Copper
8.50 Parts Silver
10.27 Parts Zinc
0.50 Parts Germanium
0.07 Parts Iridium

EXAMPLE 21

33.33 Parts Gold
45.40 Parts Copper
8.00 Parts Silver
10.27 Parts Zinc
1.00 Parts Germanium
2.00 Parts Nickel

EXAMPLE 22

33.33 Parts Gold
45.40 Parts Copper
8.00 Parts Silver
10.27 Parts Zinc
1.00 Parts Germanium
2.00 Parts Cobalt

EXAMPLE 23

33.3 Parts Gold
15.4 Parts Zinc
6.66 Parts Silver
0.674 Parts Germanium
0.066 Parts Iridium
2.00 Parts Copper

EXAMPLE 24

33.3 Parts Gold
22.0 Parts Silver
34.07 Parts Copper
0.66 Parts Germanium
0.07 Parts Iridium
9.90 Parts Zinc Each of the above-described examples was employed in test castings using 50 percent scrap from previously made castings replenished with 50 percent new grain.

As might be expected, the examples containing iridium provided adequate form filling and reasonable surface roughness. Most importantly, these examples produce the least porous castings of any of the above examples. The grain size was significantly low, in the order of 0.035–0.050 mm in relatively thin sections. These examples were particularly suited for casting with intricate shapes and fine detail. Because of low porosity, they were suitable for large castings as well. There was a complete absence of dendritic patterns.

Those examples containing cobalt produce larger amounts of slag, but no significant impact on porosity. Again, as expected, cobalt did perform considerable grain refinement with narrow shank sections having grain sizes ranging from 0.025 to 0.070.

However, with the total elimination of silicon, there was no observable reduction in strength. None of the cast surfaces of the alloys were as bright as might be obtained with the use of silicon, but those examples containing iridium and cobalt produced cast surfaces which were reasonably smooth. A pickling treatment in most cases produced an adequately shiny surface.

Because boron was not used, again, hard spots were avoided with accompanying reasonable grain size. All the tests were conducted using vacuum assist casting machines that utilize an induction heated crucible with a sealing rod. It was observed that without the use of flux, there was no development of slag sufficient to clog the drain hole in the crucible or cause the rod closing the hole to become stuck, thus establishing that the germanium, by itself, provided sufficient deoxidizing in the case of relatively high gold content alloys. By using a graphite crucible, the carbon, in turn, displaces the then formed germanium oxide and germanium dioxide on a continuous basis, so that the germanium contained in the subsequently recycled metal is in active condition.

In those installations in which a sealed graphite crucible is not available, and the melting is performed in an open non-graphitic crucible using a gas fired furnace, there will be normally greater amounts of free oxygen present. In such cases, trace amounts of boron or silicon or both can be introduced with a limit of no more than 30 parts per million of boron in up to 14 karat yellow gold; and up to 0.058% silicon in 14 karat yellow gold. In the case of 10 karat yellow gold, the silicon level may be no greater than 0.076 percent.

These levels can be used with cobalt and nickel without exceeding a point where hard spots will become objectionable. The danger of hard spots becomes excessive with the presence of over 0.04 percent iridium or ruthenium present.

The following examples are illustrative:

EXAMPLE 25

44.67 Parts Gold
39.651 Parts Copper
11.32 Parts Silver
5.83 Parts Zinc
0.29 Parts Germanium
0.076 Parts Silicon
2.00 Parts Cobalt
0.003 Parts Boron

EXAMPLE 26

41.67 Parts Gold
39.651 Parts Copper
11.32 Parts Silver
5.83 Parts Zinc
0.29 Parts Germanium
0.076 Parts Silicon
2.00 Parts Nickel
0.003 Parts Boron I wish it to be understood that I do not consider the invention to be limited to the precise details set forth in the specification, for obvious modifications will occur to those skilled in the art to which the invention pertains.

I claim:

1. A yellow gold 10 karat alloy suitable for investment casting of articles of jewelry consisting essentially, by weight, of approximately:

41.67 parts gold
28.5 parts copper
7.08 parts silver 5.0 parts zinc
1.0 part germanium
and one or more grain refining components selected from the group consisting of:
about 0.04 parts iridium
0.83 parts nickel
2.0 parts cobalt
0.04 parts ruthenium;
said alloy being substantially free of deoxidizing components other than germanium.

2. An 18 karat yellow gold allow consisting essentially, by weight of
75.0 parts gold
15.2 parts silver
7.32 parts copper
2.1 parts zinc
0.13 parts germanium
0.25 parts nickel
and one or more grain refining components selected from the group consisting of:
about 0.04 parts iridium
0.83 parts nickel
2.0 parts cobalt
0.04 parts ruthenium;
said alloy being substantially free of deoxidizing components other than germanium.

3. A 14 karat yellow gold alloy suitable for investment casting of articles of jewelry consisting essentially of:
58.3 parts gold
29.34 parts copper
7.08 parts silver
0.21 parts germanium
and one or more grain refining components selected from the group consisting of:
about 0.04 parts iridium
0.83 parts nickel
2.0 parts cobalt
0.04 parts ruthenium;
said alloy being substantially free of deoxidizing components other than germanium.

4. An eight karat yellow gold alloy for investment casting of articles of jewelry consisting essentially of:
33.33 parts gold
45.40–47.33 parts copper
8–8.5 parts silver
10.27 parts zinc
0.50–1.0 parts germanium
and one or more grain refining components selected from the group consisting of:
0.07 parts iridium
2.0 parts nickel
2.0 parts cobalt
said alloy being substantially free of deoxidizing components other than germanium.

5. A yellow gold alloy suitable for investment casting of articles of jewelry consisting essentially by weight of:
33.3–92 parts gold
2.0–47.33 parts copper
2.0–22.0 parts silver
0–15.4 parts zinc
0.1–1.0 parts germanium
and one or more grain refining components selected from the group consisting of:
0.0–2.0 parts nickel
0.0–2.0 parts cobalt
0.0–0.10 iridium
said alloy being substantially free of deoxidizing components other than germanium.

* * * * *